US007314153B2

(12) United States Patent
Musarella et al.

(10) Patent No.: US 7,314,153 B2
(45) Date of Patent: Jan. 1, 2008

(54) BELT MOUNTED TOOL HOLDER

(75) Inventors: Michael Musarella, Staten Island, NY (US); Steve Hnatowicz, Brodheadsville, PA (US)

(73) Assignee: EZ Hook, Inc., Gilbert, PA (US)

( * ) Notice: Subject to any disclaimer, the term of this patent is extended or adjusted under 35 U.S.C. 154(b) by 520 days.

(21) Appl. No.: 10/079,848

(22) Filed: Feb. 22, 2002

(65) Prior Publication Data

US 2003/0160075 A1 Aug. 28, 2003

(51) Int. Cl.
*A45F 5/00* (2006.01)

(52) U.S. Cl. ..... 224/269; 224/247; 224/660; 224/663; 224/666; 224/680; 224/682; 224/904

(58) Field of Classification Search ..... 224/197, 224/234, 247, 268, 269, 680, 682, 684, 904, 224/194, 200, 232, 233, 255, 272, 660, 663, 224/666, 667, 668
See application file for complete search history.

(56) References Cited

U.S. PATENT DOCUMENTS

| | | | | |
|---|---|---|---|---|
| 1,326,887 | A | 12/1919 | Wood | |
| 1,625,920 | A * | 4/1927 | Thurman | 224/666 |
| 3,200,536 | A | 8/1965 | Petitto, Sr. | 46/51 |
| 3,777,953 | A | 12/1973 | Lewis | |
| D240,370 | S | 7/1976 | Kuehl | D2/400 |
| D258,550 | S | 3/1981 | Strauss | D2/400 |
| 4,358,036 | A | 11/1982 | Maltais | 224/252 |
| 4,372,468 | A | 2/1983 | Harvey | 224/268 |
| D273,821 | S | 5/1984 | Bianchi | D2/400 |
| 4,830,244 | A | 5/1989 | Brannon | 224/103 |
| 4,936,499 | A | 6/1990 | Gulley | 224/252 |
| 5,176,302 | A | 1/1993 | Smith | 224/252 |
| 5,210,532 | A | 5/1993 | Knoedler et al. | 340/825.69 |
| D345,052 | S | 3/1994 | Stokke et al. | D3/228 |
| 5,499,429 | A | 3/1996 | Higginbotham | 24/3.11 |
| 5,511,705 | A | 4/1996 | Dreszer | 224/252 |
| 5,512,165 | A * | 4/1996 | Liu | 224/904 |
| 5,535,882 | A * | 7/1996 | Liu | 224/247 |
| 5,540,368 | A | 7/1996 | Oliva | 224/271 |
| D374,604 | S | 10/1996 | Hnatowicz et al. | D8/373 |
| 5,695,104 | A * | 12/1997 | Darling | 224/684 |
| 5,699,943 | A * | 12/1997 | Schaefer et al. | 224/247 |
| 5,743,451 | A | 4/1998 | Kahn | 224/268 |
| 5,944,242 | A | 8/1999 | Musarella et al. | 224/667 |
| 6,062,449 | A | 5/2000 | Kahn | 224/268 |
| 6,244,485 | B1 * | 6/2001 | Holland et al. | 224/684 |

(Continued)

OTHER PUBLICATIONS

"Monster Hook", website—www.praziusa.com/monster.html, 1-page.

*Primary Examiner*—Gary E Elkins
(74) *Attorney, Agent, or Firm*—Winston & Strawn LLP

(57) ABSTRACT

The invention relates to a tool holder for mounting to a user's clothing article, such as a belt or pants pocket. The tool holder includes a first and second support members connected to each other and configured and dimensioned for receiving and hooking around the belt with the first and second support members disposed on opposite sides of the belt. A tool holding member is mounted to one of the support members and is configured for holding a tool. The support members are preferably of an injection-molded material. Also, the support members can be constructed as separate pieces that engage each other.

38 Claims, 11 Drawing Sheets

U.S. PATENT DOCUMENTS 6,264,079 B1 * 7/2001 Skaggs ..... 224/666
6,390,348 B1 * 5/2002 Godshaw et al. ..... 224/684
6,443,342 B1 * 9/2002 Kahn ..... 224/269
6,454,147 B1 * 9/2002 Marks ..... 224/268
6,457,616 B2 * 10/2002 Gagne ..... 224/197
6,508,390 B1 * 1/2003 Karpati ..... 224/200

* cited by examiner

FIG. 1
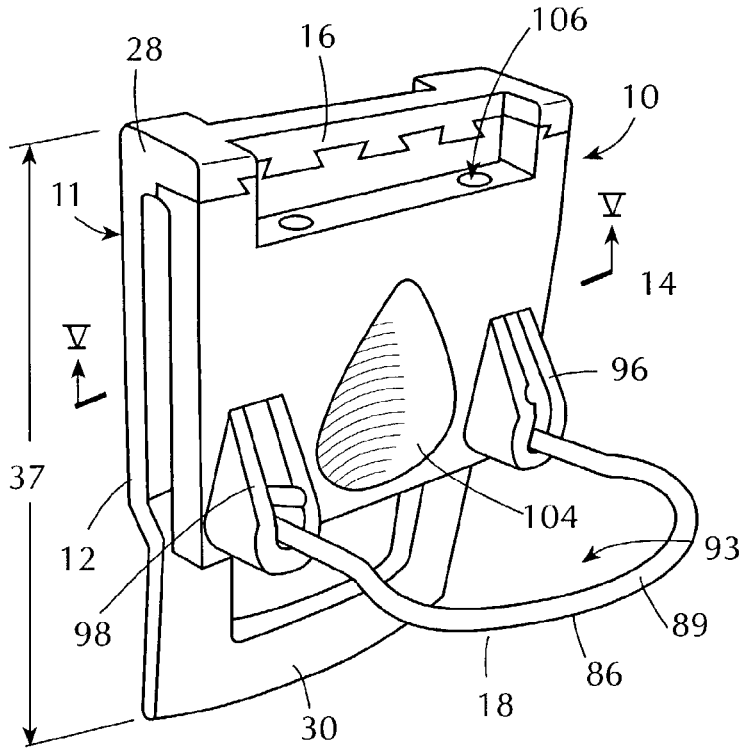
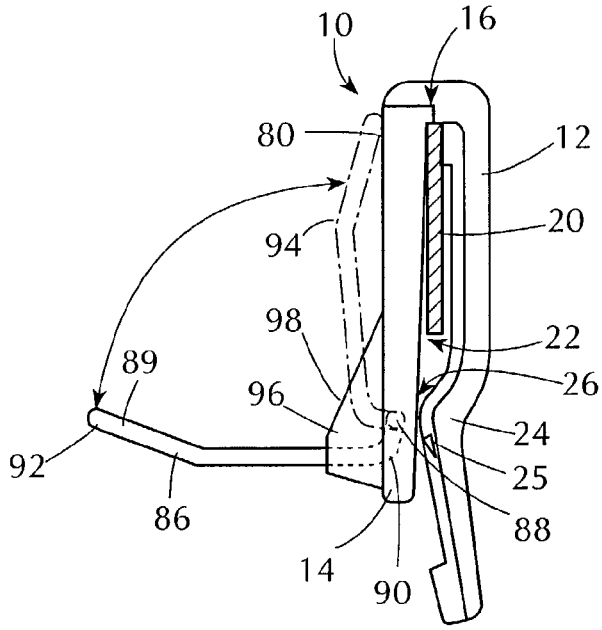
FIG. 2

FIG. 3
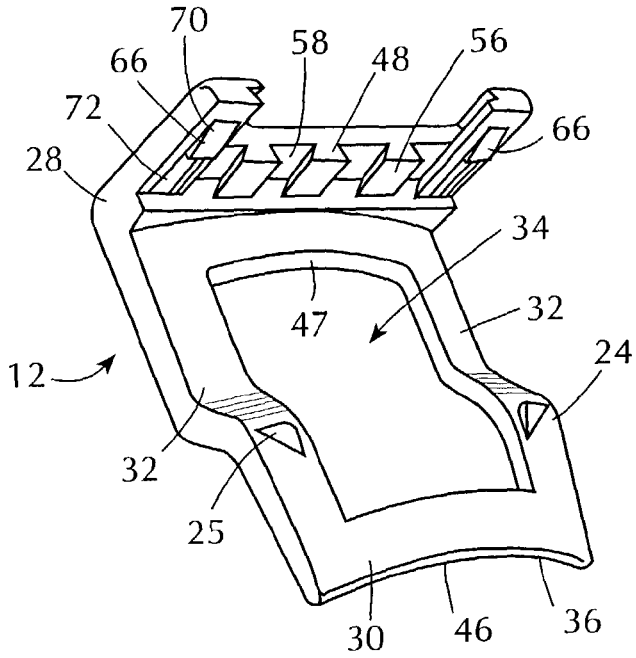
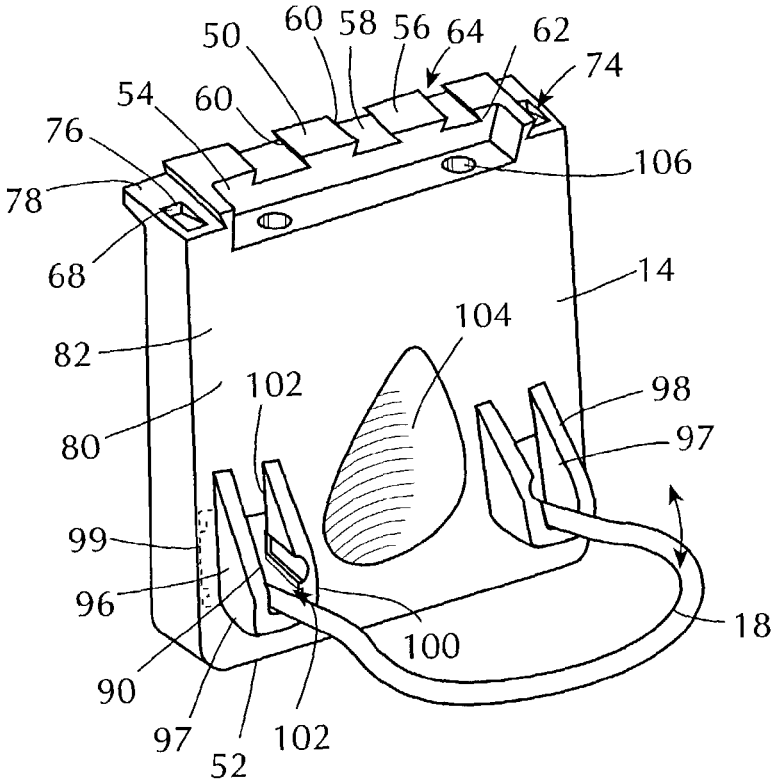
FIG. 7

BELT MOUNTED TOOL HOLDER

FIELD OF THE INVENTION

The invention relates to a tool holder that can be mounted on a belt, and more particularly to a tool holder that can be hooked on a belt to carry a hand tool.

BACKGROUND OF THE INVENTION

Belt mounted tool holders are used by carpenters, tradesmen, and home owners to carry a tool with the tool holder hooked on a belt or a pocket. In this manner, the tool can be carried hands-free and easily accessed by the user when a need for the tool arises.

Typical tool holders have portions made of bent wire that are intended to mount about a belt. The portion of these tool holders that protrudes from the mounting portions typically extends permanently therefrom, U.S. Pat. No. 5,944,242 discloses embodiments of a tool holder having supports formed as wires or rods. Brackets for holding the tool extend from the supports. U.S. Pat. No. 4,936,499 discloses a tool holder with rail members made of a heavy gage wire.

There is a need for a tool holder for handheld tools that provides increased comfort and convenience during use. The present invention satisfies this need.

SUMMARY OF THE INVENTION

The invention relates to a tool holder for mounting to a user's article of clothing, such as a belt, pants pocket, or apron, and capable of carrying a hand held tradesman's tool. A preferred embodiment of the tool holder has a first support member of an injection-molded material, which permits increased control over and available tool holder shapes and is ideal for use with materials, such as plastics. Suitable materials for injection molding include plastics, which can provide a very light weight structure and are more resistant to impact with heavy tools to be carried without yielding or permanent deformation. A second support member is preferably connected to the first support member at a connection portion, and the first and second support members are configured and dimensioned for receiving and hooking around the belt with the first and second support members disposed on opposite sides of the belt. A tool holding member is mounted to one of the support members and configured for receiving and holding a portion of a handheld tool, such as the handle thereof. The preferred tool holding member defines an opening to receive and hold the portion of the tool, and the opening is of sufficient size to receive a cylindrical object having a diameter of at least about a ½ inch.

In this embodiment, the first and second support members are made of injection molded plastic. The first and second support members are manufactured as pieces of separate construction that are joined to each other, but in another embodiment, the first and second support members are made as a single piece of unitary construction. A stiffening rib extends from preferably at least one of the support members to stiffen this support member, and a plurality of stiffening ribs are preferably provided and arranged to substantially form a truss. At least one of the preferred support members includes a protrusion that extends towards the other support member to resist removal of the tool holder from the belt.

The preferred first support member is curved to generally follow the curved shape of a user's waist. Preferably, this first support member has a curved surface facing towards and/or away from a belt space in which the belt is received between the support members, and is disposed to contact the belt in the belt space. The preferred first support member also comprises a first bottom end disposed below the connection portion and has a height between the connection portion and the first bottom end. First and second legs extend along more than about half of the height of the first support member. A bottom leg-connecting portion of the first support member connects the first and second legs at or near the first bottom end of the first support member.

One preferred tool holding member has an operative position extending from the second support member for holding the tool and is retractable to a retracted position for decreasing the bulk of the tool holder preferably when a tool is not being held. The tool holding member is disposed substantially flush against the second support member in the preferred retracted position. The tool holding member is preferably pivotally connected to the second support member for pivoting between the operative and retracted positions. Most preferably, the second support member comprises a front face facing away from the second support member, and the tool holding member is pivotable about an axis extending approximately parallel to the front face.

An embodiment of the invention includes a secondary tool holding member associated with at least one of the support members and tool holding member and configured for holding a second tool. One preferred secondary tool holding member defines at least one secondary tool recess configured and dimensioned for receiving and holding the secondary tool. This recess can include a cylindrical portion configured and dimensioned for holding a drill bit. Additionally, at least one of the support members preferably defines a grasping recess that is sufficiently large to permit grasping by a user of a portion of a secondary tool disposed therein, with the secondary tool holding member disposed for access thereto by the user in the grasping recess. The grasping recess and secondary tool holding members are preferably configured for holding the secondary tool in the secondary tool holding member with a graspable portion of the secondary tool protruding from the secondary tool holding member and disposed so that the user can grasp a portion of the secondary tool that is located within the grasping recess.

An embodiment of the secondary tool holding member comprises at least one resilient protrusion for engaging a recess of the secondary tool. Preferably, a plurality of resilient protrusions of the secondary tool holding member are configured and dimensioned for engaging the mounting holes of sockets for a socket wrench, and the resilient protrusions are movable with respect to each other to accommodate differently sized sockets.

The preferred first and second connection portions for connecting the support members are securable to each other in attached association. Preferably, the connection portions are configured for engagement with each other, and a locking portion is associated with the support members for locking the support members together in secured association. In one embodiment, at least one of the connecting portions comprises a connecting extension, and at least the other of the connecting portions comprises a connecting recess configured to engage the connecting extension for securing the first and second connecting portions to each other. The first and second support members of this embodiment are substantially coupled to each other with the connecting portions in the attached association. A plurality of second support members and tool holders having different configurations for holding different tools can be manufactured for use with a single embodiment of the first support member to reduce manufacturing complexity and cost.

The front face of the second support portion of an embodiment of the invention has a recess facing the tool holding member. This recess is configured and dimensioned for receiving a portion of the tool held in the tool holding member. The tool holding member of this embodiment has a rounded portion, defining a rounded shape for holding a round portion of the tool. The recess comprises an indentation in the second support member disposed substantially concentrically with the rounded shape of the tool holding member.

A preferred embodiment of the invention has a notch in the tool holding member configured for receiving and positioning a portion of the tool in a predetermined orientation. Also, a preferred tool holding member defines first and second openings on opposite sides of and communicated with the tool space, wherein the first opening is larger than the second opening for receiving a larger portion of the tool than the second opening.

The tool holding member may have a mounting portion that is received and supported in a recess of the second support member, with a closure attached adjacent the recess for closing the recess and retaining the holding member mounting portion pivotally therein. Also, a mount can be pivotally attached to the second support member and pivotally support the holding member, with first and second portions of the mount disposed about the holding member to trap the holding member in the mount. A deflecting ramp may also be provided adjacent to the mounting portion of the holding member and configured and angled for deflecting impact from the tool as it is moved towards the tool holding member to be held thereby. Additionally, a retaining member may by configured for attaching the tool holding member to the second support member, with the retaining member being in a snap-fit association with the second support member.

The present invention provides a tool holder that provides increased convenience and comfort.

BRIEF DESCRIPTION OF THE DRAWINGS

FIG. 1 is a front, top perspective view of an embodiment of a tool holder constructed according to the present invention;

FIG. 2 is a side view of the tool holder of FIG. 1;

FIG. 3 is a bottom, front perspective view of the back support member of the embodiment of FIG. 1;

FIG. 7 is a front perspective view of the front support member and tool holding member of the tool holder of FIG. 1;

DETAILED DESCRIPTION OF THE PREFERRED EMBODIMENTS

Figure 4:
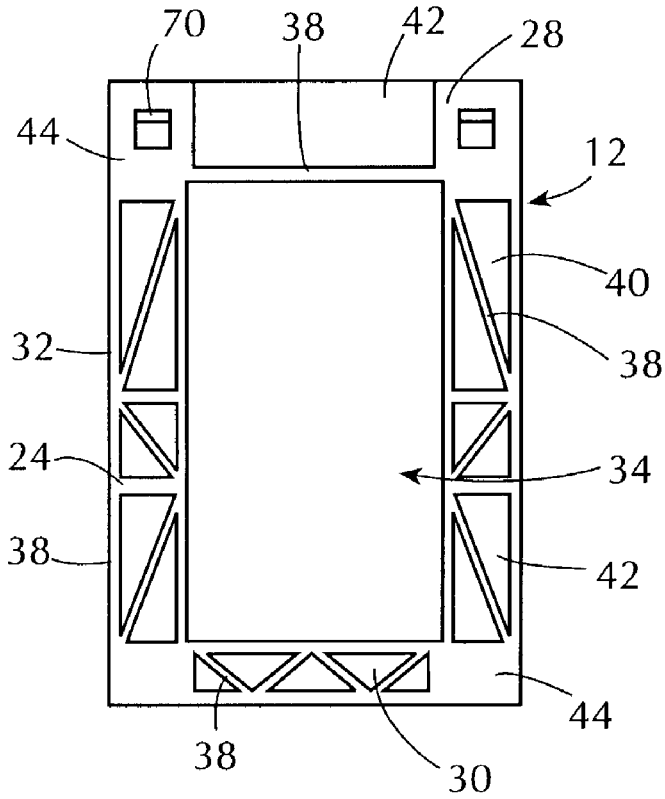
FIG. 4 is a back view of the back support member.

Referring to FIG. 1, a preferred embodiment 10 of a tool holder includes a preferably U-shaped belt-hook portion 11 with back support member 12 and a front support member 14. The front and back support members 12,14 are connected to each other at a connection portion 16, which is preferably disposed on a top side of the hook portion 11, and connects the top ends of the front and back support portions 12,14. A tool holding member 18 is preferably attached to the front support member 14 in supported association therewith and is configured for holding a tool.

As shown in FIG. 2, the back and front support members 12,14 are configured and dimensioned for receiving a belt 20 therebetween. The back and front support members 12,14 are shown hooked around the belt 20 with the support members 12,14 disposed on opposite sides of the belt 20. The belt 20 is received within a belt space 22, which is open preferably on lateral sides thereof and at a bottom side where the front and back support members are spaced or spaceable for inserting the belt 20 into the belt space 22. The support members 12,14 are configured for substantially trapping the belt 20 in the belt space 22. Preferably for this purpose, at least one of the support members 12,14, and preferably the back support member 12, has a restricting portion 24 that protrudes towards the other of the support members 14 at an angle to restrict the belt space 22 between the support members 12,14. The preferred back support member thus has as S-curve shape when viewed from the side. As a result, the belt space 22 is wider than the space 26 between the restricting portion 24 and the front support member 14. This improves the retention of the belt 20, and provides a more secure mounting to the belt 20.

In addition, the preferred embodiment has belt retaining protrusions, which preferably comprise nubs 25 disposed adjacent or on the restricting portion 24, and preferably protruding substantially towards the belt space 22. The nubs 25 are sloped on their bottom side to slide easily around a belt or pants pocket, camming the back support member 12 away from the belt and front support member 14. The upper side of the nubs 25, facing the connection portion 16, is preferably sloped more steeply than the bottom side of the nubs with respect to the belt space 22 for catching on the belt to resist removal therefrom.

Figure 5:
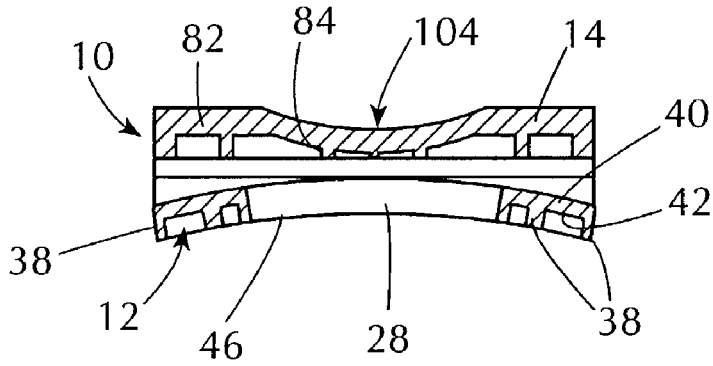
FIG. 5 is a bottom cross-sectional view along line V-V of FIG. 1.

Referring to FIGS. 3-5, the back support member 12 of the preferred embodiment has top and bottom portions 28,30 and legs 32 joining and extending between the top and bottom portions 28,30. Preferably, the back support member 12 has a at least one leg, more preferably a plurality of legs, and most preferably two legs. A back opening 34 is defined between the legs 32, and the shape of the back opening 34 is preferably selected depending on the properties of the material of which the legs 32 are constructed, such as to obtain a desired flexibility and strength of the back support member 12. The location and shapes of the back opening 34 and of the legs 32 are also preferably selected for localizing any areas of increased flexibility or stiffness. The legs 32 preferably extend along more than about half of the height of the back support member 12. The bottom portion 30 includes a connecting piece that connects the legs 32 at or near the back bottom end 36 of the back support member 12. The back support member 12 preferably has a height from the top of the connection portion 16 to the back bottom end 36, with the legs 32 extending along more than about half of that height 37.

The back support member 12 is stiffened by stiffening webs or ribs 38 that preferably extend from a laterally extending web 40, as shown in FIG. 4. The embodiment shown includes a plurality of stiffening ribs 38 arranged substantially in a truss to control the bending stiffness of the back support portion 12. The preferred truss includes ribs 38 in diagonal, horizontal, and vertical orientations adjacent recessed areas 42. Other portions of the back support member are free of ribs, preferably in the corner areas 44 of the back support member 12.

The back support member 12 of the embodiment shown has a concave curved back side 46, with the center part of the back side 46 disposed inwardly with respect to the lateral edges of the back side 46. The curvature is preferably selected to follow the shape of a user's waist and has a substantially constant radius, although a varying radius curve may be used. The curved back support member 12 can increase comfort and increase the stability of the tool holder 10. The front-facing side 47 of the back support member is preferably also curved to generally follow the curve of the user's waist and to reduce wear on the belt to which the tool holder 10 is mounted.

The connection portion 16 of the tool holder 10 of the preferred embodiment, the back and front support members 12,14 respectively include back and front connection members 48,50, as shown in FIGS. 3 and 7. The back and front connection members 48,50 are preferably each disposed upwards from the back and front bottom ends 36,52, and more preferably at or near the top ends or top portions 28,54 of the back and front support members 12,14.

The connection members 48,50 of this embodiment are securable to each other in attached association. Preferably, the connection members 48,50 are configured to engage each other to couple the back and front support members 12,14. The preferred connection members 48,50 have a dove tail joint with connecting extensions 56 and connecting recesses 58. The connecting recesses 58, preferably are configured as key ways, are capable of slidably receiving the connecting extensions 56, which are preferably configured as keys that snuggly fit into the recesses 58.

The connecting extensions and recesses 56,58 of the preferred embodiment are disposed directly adjacent each other, and the dovetail connecting extensions 56 have a corresponding shape to the connecting recesses 58. The connecting extensions 56 include flared ends 60, which are held by recessed inner edges 62 of the connecting recesses 58, as the width of the connecting recesses 58 at their mouths 64 is greater than the width of the connecting extensions 56 at a location received within the connecting recesses 58.

The connecting portion 16 of the tool holder also preferably comprises a locking portion for locking the support members 12,14 together in secured association. The locking portion of the preferred embodiment includes corresponding back and front locking members 66,68, respectively. One of the locking members, preferably the back locking member 66, has a resilient tab 70 that is configured for flexing into a corresponding recess 72 of the back support member 12, preferably by resilient deformation. The tab 70 preferably has a sloped front surface disposed to be cammed by a portion of the other support member, preferably the front support member 12, biasing the tab 70 into recess 72.

The other locking member 68, which as indicated is preferably part of the front support member 14, defines a locking recess 74. Locking recess 74 is configured for receiving the tab 70. In the preferred embodiment, locking member 68 includes a cam surface 78 disposed for biasing the tab 70 into recess 72 as the back and front support members 12,14 are slid onto each other with the connection members 48,50 engaged or becoming engaged. When the end of the tab 70 has passed back wall 76 of the locking recess 74, the tab extends into the locking recess 74. The back wall 76 is positioned and configured to prevent extraction of the tab 70 once it is received therein, locking together the back and front support members 12,14. Additionally, in the preferred embodiment, the back and front support members 12,14 are configured to restrict or prevent access by the user to the locking members 66,68 once the support members 12,14 are locked together. The locking members 66,68 are preferably disposed on opposite lateral sides of the support members 12,14 to restrict pivoting between the support members 12,14 about a vertical axis, but other locations of the locking members 66,68 are alternatively suitable.

In an alternative embodiment, different connecting and locking members are employed. In one embodiment, the connecting and locking members comprise fasteners, such as screws, an adhesive, or a weld to hold the support members together. In another embodiment, the front and back support members are of unitary construction, and the connecting portion is thus another part of the unitary support assembly.

Providing separate front and back support members 12,14 reduces the complexity and cost of the molds required to injection mold the preferred tool holder. To further reduce the cost of a manufacturing operation, a common mold is used to manufacture a common back support member 12 for a plurality of different front support members with their respective tool holding portions.

Figure 8:
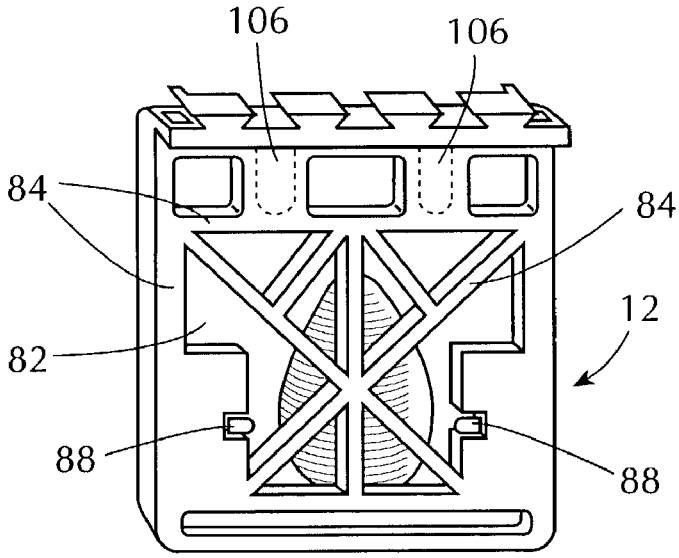
FIG. 8 is a rear perspective view of the tool holding member of FIG. 7.

In the embodiment of FIG. 1, tool holding member 18 is mounted extending forward from the lower front surface 80 of the front support member 14. The front surface 80 is preferably substantially flat, but may have an alternative shape and may be curved. Preferably, as shown in FIG. 8 the front surface is part of a front web or wall 82 that extends laterally and is supported at its rear, facing the back support member 12, by a plurality of stiffening ribs 84, which are preferably arranged as a truss. Similarly to the ribs 38 of the back support member 12, the arrangement and configuration of the ribs 84 of the front support member are selected to obtain the desired stiffness and lightness of the front support member 14.

The tool holding member 18 of this embodiment comprises a loop 86, with ends 88, visible in FIGS. 2 and 8, that are mounted to the front support member 14. The loop 86 is preferably made of a wire of steel or other metal, but can alternatively me made of another suitable material, such as a plastic or composite, and can also be molded with the front support member 14 in unitary construction therewith.

The loop 86 is preferably closed with a front portion 89 that is angled upwards to gravity bias the held tool toward the wall of the front support member. Preferably, the ends 88 are movably, and more preferably pivotally, connected to the front support member 14. Bent elbow portions 90 connect the ends 88 with the main portion of the loop 86 that is exposed to contact and carry a tool. The elbow portions 90 and ends 88 are configured in this embodiment so that the loop 86 can be pivoted towards the front support member 14 between and extended holding position 92, in which the loop 86 is operable to define an opening 93 for receiving and holding the tool, and a retracted position 94 adjacent the front support member 14. The preferred pivoting of the loop 86 with respect to the front support member 14 is about an axis that extends laterally, and shown in FIG. 2. In the retracted position 94, the loop 86 is preferably disposed substantially flush against the front support member 14. A user can wear the tool holder 10 comfortably with the loop 86 in the retracted position 94 when a tool is not being held.

Loop supports 96 preferably extend forward from the front support member 14 and on the lateral and bottom sides of the loop 86. The bottom part of the loop supports 96 are positioned and configured to support the loop 86, in tension or alternatively in compression, in the extended position 92 to hold the tool. The sides of the loop supports 96 preferably include ramps 98 extending substantially from the front wall 80 to the bottom part of the loop supports 96 to reduce catching the tool on the loop supports 96 when the tool is being inserted in the tool holder 10.

The loop supports 96 also include a widened gap area 100 to allow the loop 86 to pivot with little resistance between the extended and retracted positions 92,94. The loop supports 96 also define narrow gap areas 102 at or near the location of the loop 86 at the extended and retracted positions 92,94, preferably to frictionally retain the loop 86 in these positions, at which the lateral walls of the supports 96 are resiliently biased by the loop 86 when it traverses the narrow gap areas 102. The loop supports 96 are preferably configured to resist the loop 86 from backing up toward the retracted position. An alternative embodiment has a protrusion or area of the wall of at least one of the loop supports to catch or frictionally engage the loop in one or both of the extended and retracted positions. To facilitate manufacturing and provide more flexible lateral sides of the loop supports 96, preferably one of the lateral sides 97 of each loop support is molded or otherwise made separately from the front support member 14 and is attached thereto, such as by snapping a tab 99 into the front support member 14.

The tool holding member 18 is preferably configured for holding a hand-held tool, preferably useful in tasks such as carpentry, gardening, or construction. Preferably, the tool holding member 18 is configured for receiving a portion of a tool, such as a handle thereof, while blocking passage therethrough of another portion of the tool that is wider than the received portion. The loop 86 of the preferred embodiment is of sufficient size to receive the handle of a household hammer, yet small enough to hold the hammer with the hammer head resting on the loop 86 and preventing the hammer head from sliding through the loop 86. The diameter and size of the loop 86 is also preferably selected to receive the handle of a large flashlight, while preventing the head of the flashlight from sliding therethrough.

Figure 6:
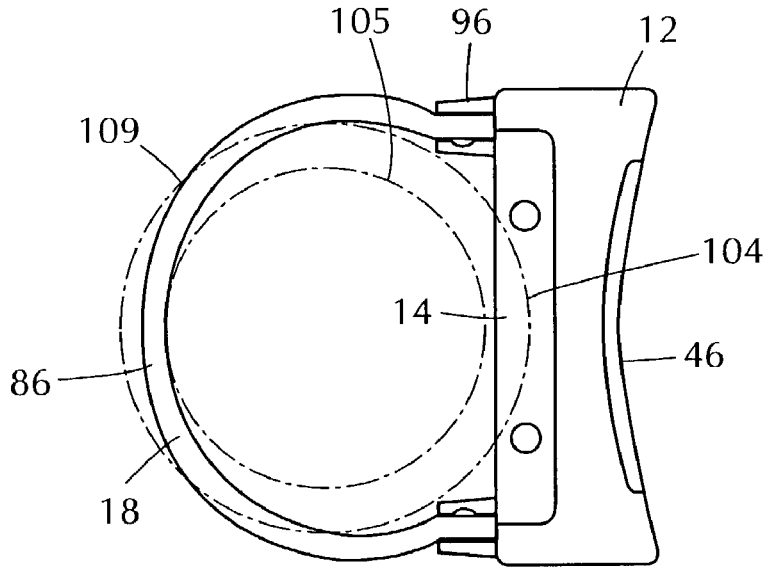
FIG. 6 is a top view of the tool holder of FIG. 1.

As shown in FIGS. 1, 6, and 7, the front surface 80 of the front support member 14 defines a tool accommodating recess 104. The tool accommodating recess 104 faces the loop 86 and is configured, disposed and dimensioned to receive a portion of the tool held in the loop 86. Referring to FIG. 6, the tool accommodating recess 104 concentric with and larger than a circle 105 defined by the outer portion of the loop 86, and preferably is an indentation that is concave both vertically and laterally, forming a teardrop shape on the front surface 80. A handle of a flashlight is shown in phantom lines at the circle 105 received through the loop 86, and the head of the flashlight is shown be phantom circle 109, which is larger than the diameter of the loop 86, and is received in the tool accommodating recess 104, which thus increases maximum tool size that can be held in the tool holder 10.

The tool holder 10 has a secondary tool holding member, which is configured to hold secondary tool that is preferably smaller than the tool capable of being held in the tool holding member 18. In this embodiment, the secondary tool holding member is associated with the front support member 14 and includes holes 106, which are preferably cylindrical or frustoconical, or otherwise tapered, preferably narrowing with increasing depth. Tapered holes 106 better resist obstructive impact with repeated use and can be shaped to stabilize screw driver tips. The tapered holes 106 of the preferred embodiment are dimensioned to receive and hold tools or tool attachments, such as screwdriver drill bits. Preferably a plurality of upwardly facing holes 106 are defined in the front support member 14.

Figure 8B:
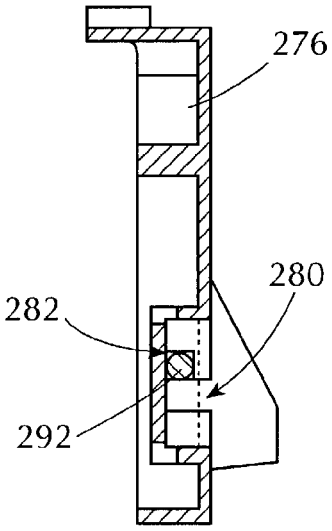
FIGS. 8A and 8B are a front and cross-sectional side view, respectively, of another embodiment of a front support member.
Figure 8A:
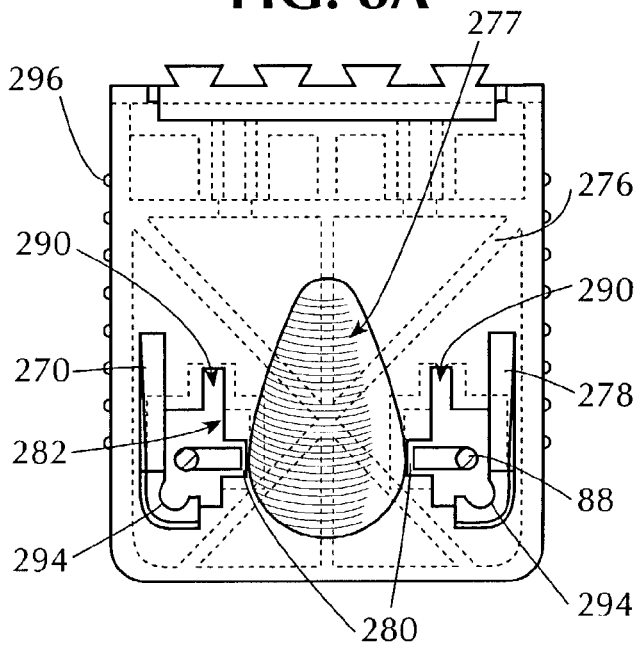
Figure 8C:
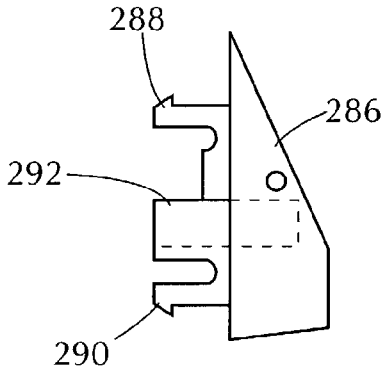
FIG. 8C is a side view of a loop support of the front support member of FIGS. 8A and 8B.

Referring to the embodiment of FIGS. 8A-C, front support member 276 has a tool accommodating recess 277. Outside loop supports 278 are molded unitarily with the front support member 276. FIG. 8A shows the ends 88 of the tool holder loop inserted into openings 280 during assembly. The loop ends 88 are then moved upwards into retention cavities 282. Inner loop supports 286 have resilient legs 288 configured to snap into and engage support openings 290 of the front support member 276. Retaining wall 292 of the inner loop support 286 retains the loop ends 88 in the retention cavities 282 when the inner loop support is mounted to the front support member 276. The outer loop supports 278 include at their lower ends an enlarged loop retaining area 294 configured for receiving and inhibiting or preventing the loop from being accidentally rotated upwards from the extended position when a tool is extracted therefrom. The loop supports 278,286 preferably comprise ramps to deflect the impact adjacent the mounting ends 88 from a tool that is hastily inserted into the loop. Gripping ribs 296 extend laterally along the lateral sides of the front support member 276 to facilitate grasping.

Figure 9:
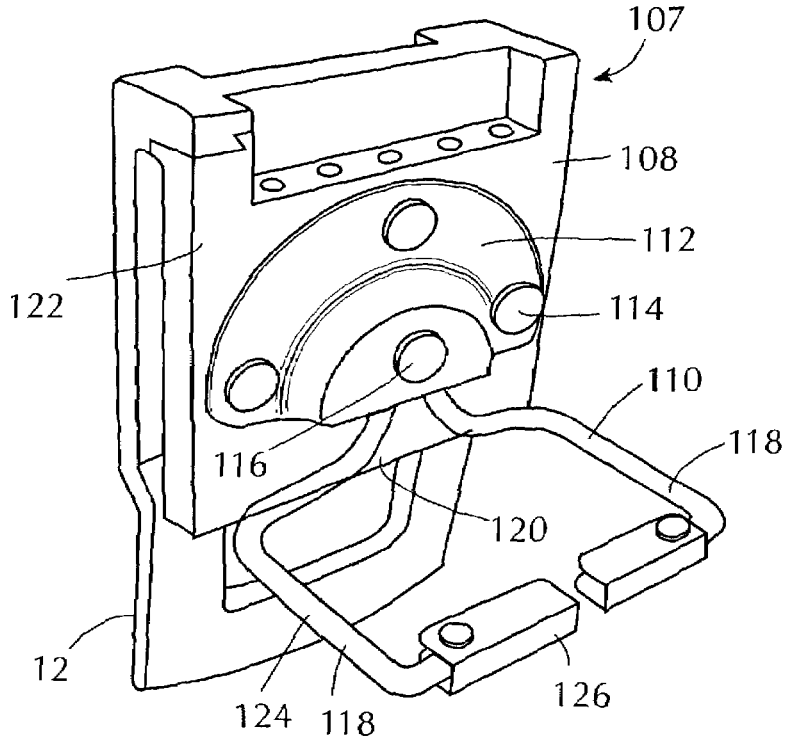
FIG. 9 is a perspective view of another embodiment of the invention with pivoting gates.
Figure 10:
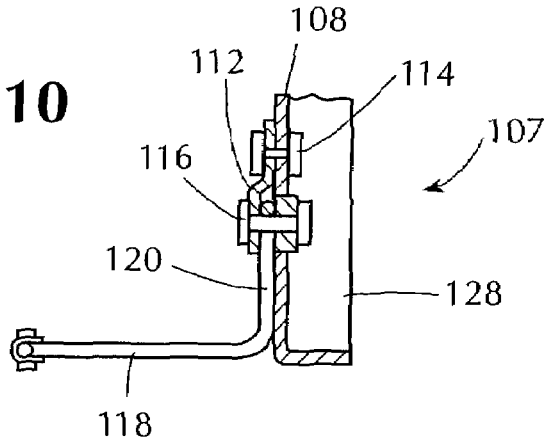
FIG. 10 is a side cross-sectional view of the front support member of the embodiment of FIG. 9

Referring to FIGS. 9 and 10, another embodiment of a front support member 108 and tool holding member 110 is shown attached to a back support member 12 of similar construction to the back support member of the embodiment of FIG. 1. The tool holder 110 has a faceplate 112 mounted to front support member 108, preferably with rivets 114. The faceplate 112 and the front support member 108 support a pivot pin 116, which is preferably a rivet, from which a tool holding bracket 118 is pivotally supported.

The rivets 114,116 are preferably disposed inwards, or forward, of the back part of the front support member 108.

Thus, the back rear heads of the rivets, or other fasteners used, are preferably recessed or concealed to prevent their catching on a user's clothes or belt. An alternative embodiment has ornamental rivet heads molded into the faceplate 112, which itself is molded along with the front support member 108 as a unitary piece. In the embodiment of FIGS. 9 and 10, ribs 128 of the front support member 108 extend further back towards the belt space than the rivets 114,116.

The bracket 118 is preferably made from bent metal wire, and the faceplate 112 from stamped sheet metal, but may alternatively be made of other suitable materials. Bracket 118 includes upright portions 120 that permit the bracket 118 to pivot about an axis normal to the front surface 122 of the front support member 108, as biased by the weight of the tool to increase the stability of the tool in the tool holder 107. The bracket 118 also includes substantially horizontal portions 124 to hold a tool.

Front gates 126 are mounted to the ends of the horizontal portions 124. The front gates 126 are resiliently biased, preferably by springs, towards their closed position shown, but can be pivoted inwardly by pressing thereagainst a tool to be held.

Figure 10A:
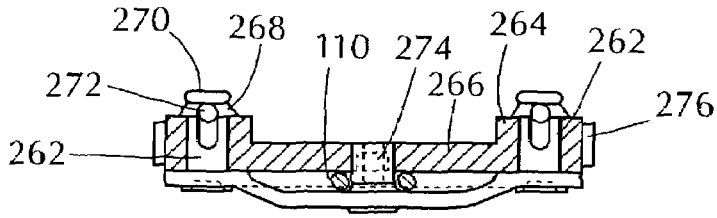
FIG. 10A is a top cross-sectional view of another embodiment of a front support member and faceplate.

Referring to the embodiment shown in FIG. 10A, faceplate 260 is made of a molded plastic. Faceplate 260 includes at least one and preferably a plurality of attachment protrusions 262 that are engaged and received in openings 264 of front support member 266. Enlarged locking members 268 at the ends of the protrusions 262 have an enlarged diameter and are resiliently contractible and expandable to fit through openings 264 and to has a larger diameter than the openings 264 to lock to the front support portion 266. Locking buttons 270 with locking balls 272 engage preferably the interior of the locking members 268 to keep them in the locked and expanded. Also, a bracket support protrusion 274 extends from the front of the faceplate 266 into the front support member and is preferably supported thereby. Bracket 110 pivotally hangs from the bracket support 274. Ribs 276 or other bumps extend from the lateral sides of the front support member 266 to facilitate gripping.

Figure 11:
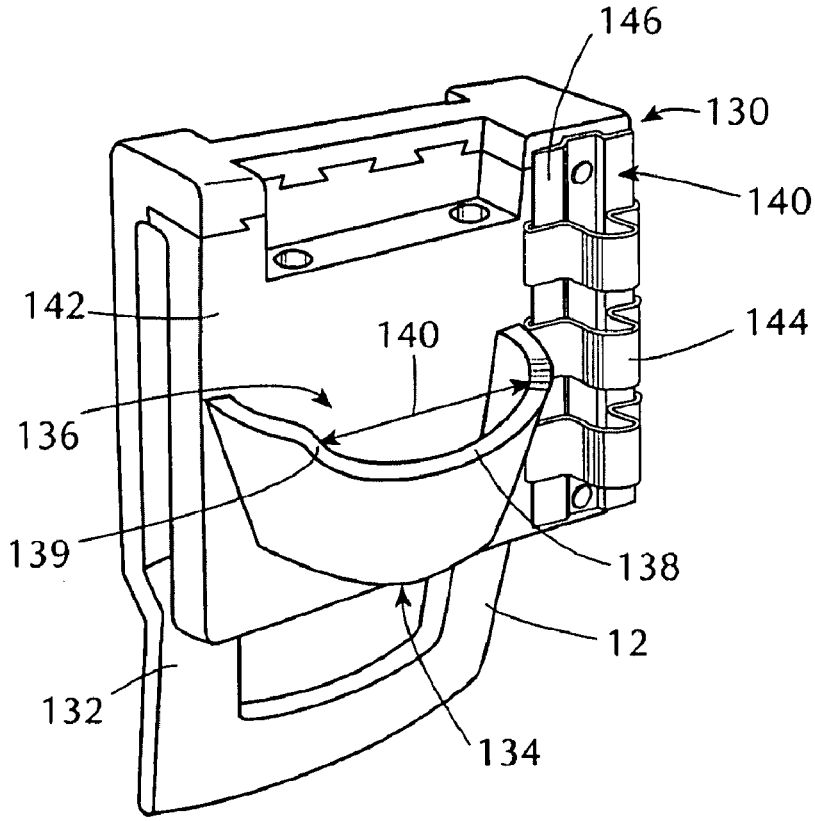
FIG. 11 is a perspective view of another embodiment of the invention with a conical tool holding member.
Figure 12:
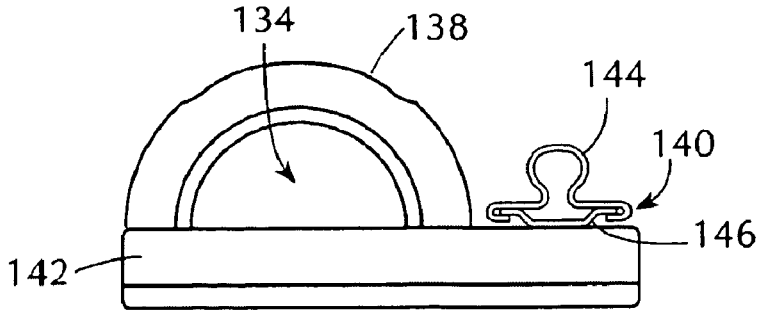
FIG. 12 is a bottom view of the front support member of the embodiment of FIG. 11.

The embodiment 130 shown in FIG. 11 also includes the same back support member as the embodiment of FIG. 1 and is particularly suited for carrying a socket wrench or other tool that has a handle and a portion extending at an angle to the handle. The tool holding portion of this embodiment includes a tapered, and preferably semiconical member 132, with a smaller opening 134 at a bottom side and a larger opening 136 at a top side. The openings 134,136 are preferably large enough to receive the handle of a socket wrench, but small enough to prevent the head of the socket wrench from passing therethrough.

The top of the semiconical member 132 has a notch 138 with raised sides 139. The width of the notch 140 is preferably within about 25% of the width of the smaller opening 134, and more preferably within about 15%. The notch 138 is configured for receiving a portion of the wrench, preferably the wrench head or an attached socket, to position the wrench in a predetermined orientation, preferably with the socket facing in a forward direction away from the user. Other embodiments have a different placement of the notch to obtain a different orientation of the held wrench or tool.

A secondary tool holding member 140 is mounted to the front support member 142. The secondary tool holding member 140 of this embodiment is configured for engaging the interior of a plurality of sockets. Preferably, the secondary tool holding member 140 has a plurality of resilient protrusions, which are preferably bent leaf springs 144, sized to fit in and engage the interior of the sockets resiliently and frictionally so that the user can keep several socket sizes close at hand. The springs are slidably mounted on track 146 so they can be repositioned depending on the placement of the sockets of different sizes.

Figure 13:
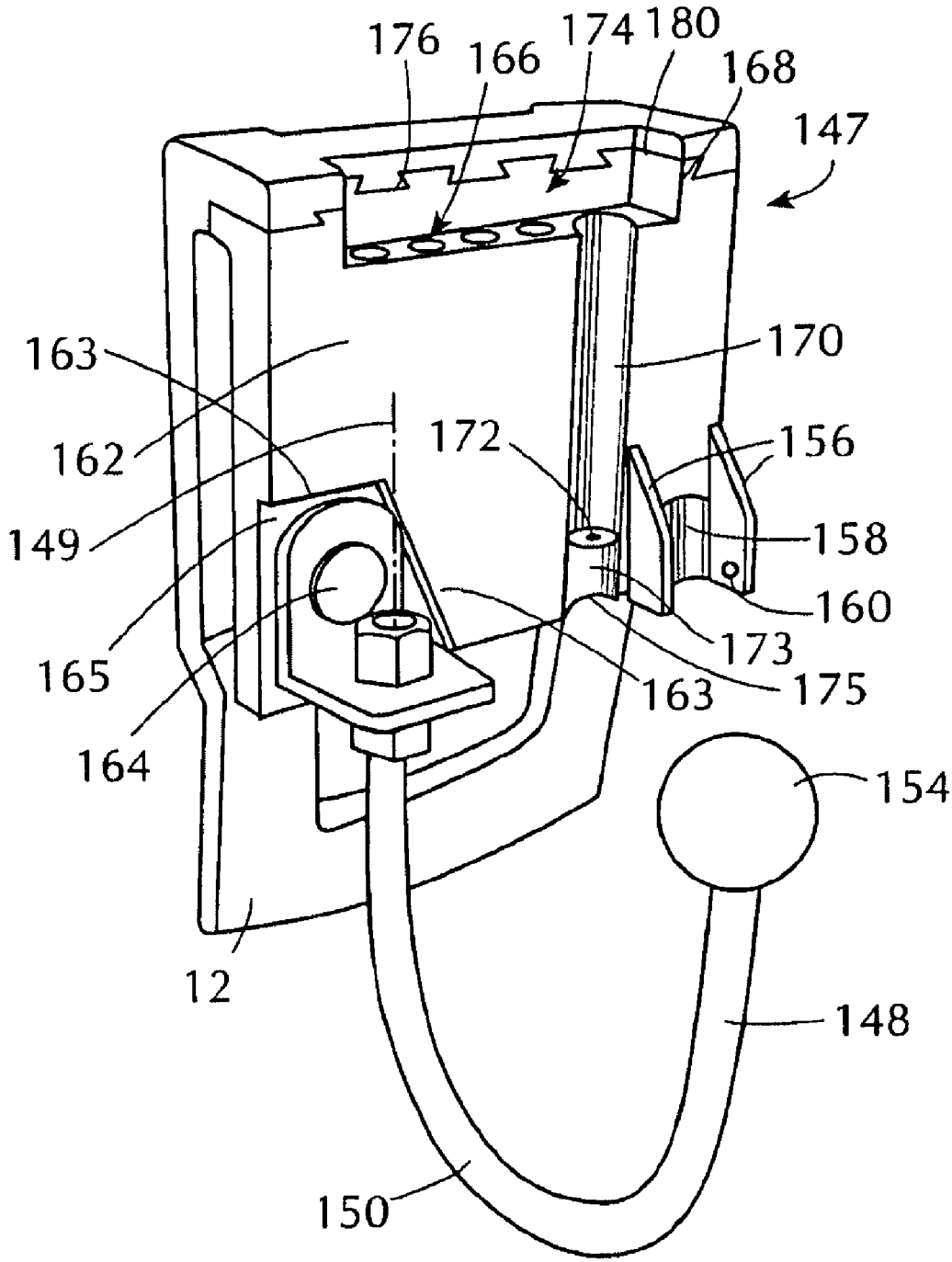
FIG. 13 is a perspective view of another embodiment of the invention with a U-shaped tool holder.

Referring to FIG. 13, an embodiment of a tool holder 147 has a tool holding member 148 with preferably U-shaped hook member 150 pivotally mounted on one side to mounting bracket 152 for pivoting about an axis 149 non-perpendicular and preferably substantially parallel to the front support portion 162. At the other end of the hook member 150 there is preferably an enlarged portion 154, most preferably comprising a ball or spherical portion. The hook member 150 is pivotable from the open, extended position shown, to a retracted position, with the enlarged portion 154 received between up-standing gripping walls 156 and in recess 158. Preferably the hook member 150 is pivotable by more than 90° and more preferably by more than 180°. Also, the hook member is preferably pivotable by less than 360°.

The gripping walls 156 are preferably configured for gripping the enlarged portion 154 to retain the hook member 150 in the retracted position. The griping walls 156 of this embodiment also preferably include a protrusion 160 positioned along the path of the hook member 150 as it is pivoted to the closed position protrusion 160 can be resiliently deflected out of the path to receive the enlarged portion 154 between the gripping walls 156. The protrusion 160 preferably retains the hook portion 150 in the retracted position in a snap-fit association.

The mounting bracket 152 itself is pivotally connected to the front support portion 162 for pivoting about an axis extending through the front support portion 162 and preferably substantially normal thereto. The pivot pin 164 is preferably recessed in the back side of the front support portion 162 to keep it from catching on a user's belt. In addition, lateral edges 163 of the recess 165 are configured for limiting the pivoting angle about the axis of pin 164. This pivot limiting helps keep the tool from falling out from the hook member 150.

The hook member 150 has a width-depth, and configuration for receiving the handle of a cordless drill, but is narrow enough to stop the enlarged battery pack located at the end of typical drill handles from sliding therethrough. As the hook member 150 is permitted to pivot about the substantially horizontal pin 164, the hook member 150 can accommodate itself to best support the drill without applying torque about the axis of pin 164 to the support members laterally.

Figure 14:
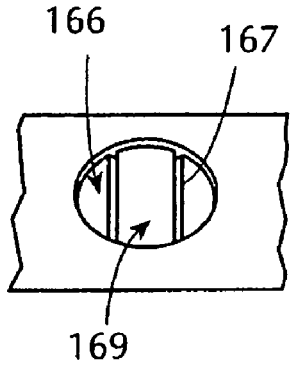
FIG. 14 is a perspective top view of a secondary tool holder of the embodiment of FIG. 13.

The tool holder 147 includes several secondary tool holding members 166,168. Secondary tool holding members 166 include holes dimensioned to receive screw driver drill tips with the tips protruding for easy grasping. A preferred embodiment of secondary holding members 166 is shown in detail in FIG. 14 and includes ribs 167. Ribs 167 preferably extend longitudinally into hole 169, preferably for creating an interference fit with the held secondary tools, and for increasing friction therewith and protecting the holder from obstructive impaction from repeated use. Alternatively, the ribs can extend in a different direction. The primary and secondary tool holding portions of other embodiments can also employ similar ribs.

Secondary tool holding member 168 is preferably configured for holding a screw driver drill shank with an external magnetic sheath of enlarged radius. Secondary tool holding member 168 includes a semicylindrical opening 170 that is open both to the front of the front support portion 162 and to the top thereof and is dimensioned for receiving and holding the wide sheathed portion of the shank with little or no play. This secondary tool holding member 168 also includes cylindrical narrower opening 172, which is preferably dimensioned to receive and hold the narrow part of the shank that is sized to be clamped in a drill chuck. Opening 172 extends through secondary tool holder base 173, which has a concave, and preferably arcuate, bottom surface 175 configured and dimensioned to receive a user's finger for pushing up on the bottom portion of the shank that protrudes past the arcuate surface 175 to extract the secondary tool. And alternative embodiment has a bottom surface that may be flat, but that slopes upwardly away from the front face of the front support member 162, so that a portion of a standard shank protrudes.

The secondary tool holding members 166,168 of this embodiment are preferably disposed in secondary recessed area 174, preferably located at the top of the support members 12,162, facing forwards away from the user. This permits the tops of the held bits or other secondary tools to protrude from the holes of the secondary tool holding members 166,168 in which they are held, yet still remain substantially or completely within the outer perimeter shape of the tool holder 147. The preferred recessed area 174 has a wall that extends along back, bottom, and lateral sides 176,178,180 of the recessed area 174. In alternative embodiments, the secondary tool holding members are disposed in other locations.

The preferred embodiments of the invention are preferably manufactured of molded material, although portions can be made of bent metal, such as wire or sheet metal. Molded parts, however, such as injection molded parts, are preferred as they permit a broad range of shapes. Suitable materials include plastics, metals, rubber, and composites such as carbon graphite. The preferred tool holders also have shapes with complex curves to obtain greater structural stiffness with less weight and bulk. Injection molded plastic parts offer the most advantageous combination of available shapes, structural properties, weight, and comfort for the user. The injection molded support portions preferably include noncircular cross-sections with a wide profile such as shown in FIG. 5, for example, preferably having an aspect ratio of at least about 3:1.

Figure 15:
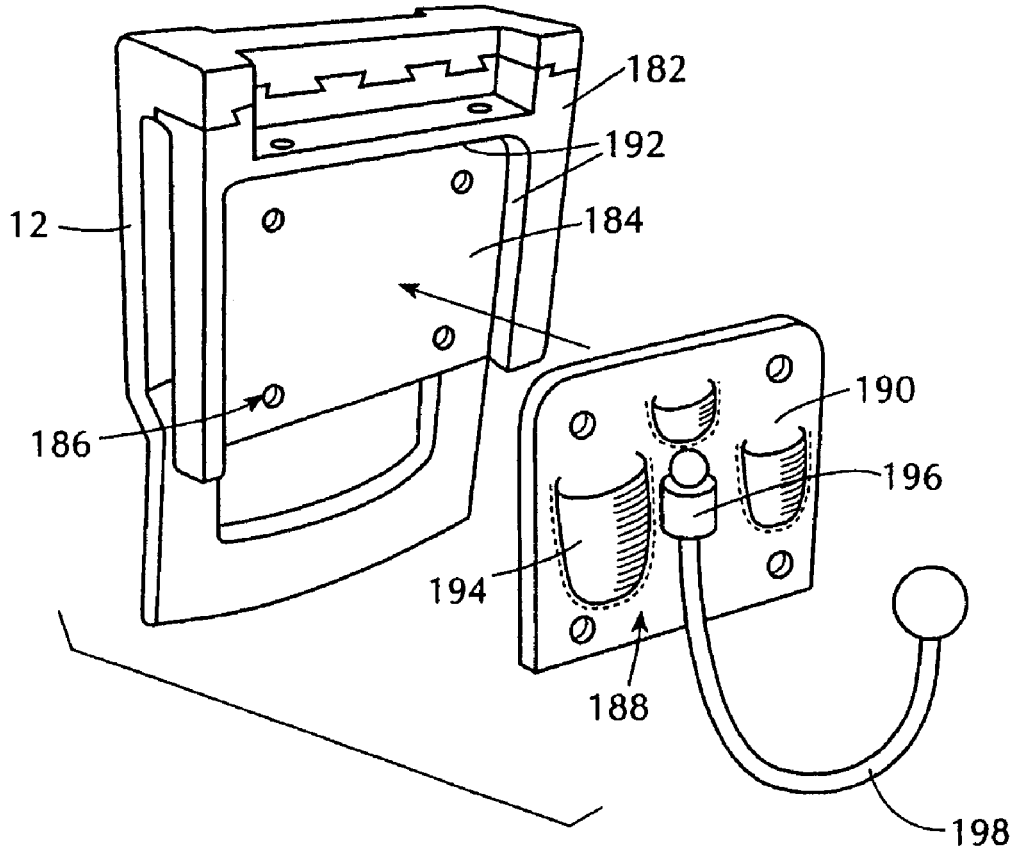
FIG. 15 is a perspective view of another embodiment of front and back support members with a recessed mounting portion.

Referring to FIG. 15, the front support member 182 defines a recessed mounting-portion 184 configured for attaching a tool holding member. The mounting portion 184 preferably includes mounting holes 186 for receiving rivets or other fasteners to attach the tool holding member. Alternative attachment arrangements may be used, such as an adhesive attachment. The tool holding member 188 to be attached preferably has mounting portion with a flat mounting panel 190 with a shape corresponding to the mounting portion 184, and can be made of a suitable material, such as leather, plastic, metal, or combinations thereof. This embodiment allows the manufacture of a single configuration of front and back support members, which may also be made as a single unitary piece, and any corresponding tool holding member can be attached. In the embodiment shown, the lateral walls 192 of the recessed mounting portion 184 help to position and stabilize the tool holder mounting panel 190, but an alternative embodiment has a mounting portion of the front support member that is substantially not recessed. The preferred mounting panel 190 also supports secondary tool holding members 194, which in the preferred embodiment are leather pockets sewn onto the mounting panel 190, and which are preferably positioned for limiting the rotation of bracket 196 and hook member 198 about an axis normal to the front surface of the mounting panel 190.

Figure 16:
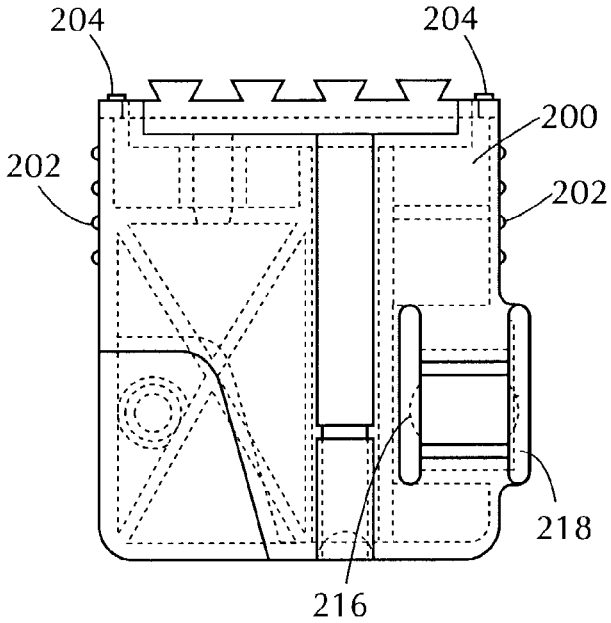
FIG. 16 is a front view of another embodiment of a front support member.
Figure 17:
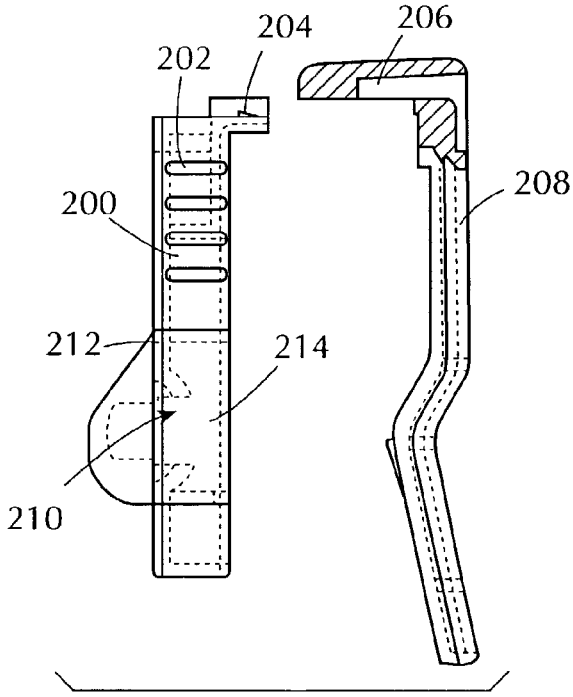
FIG. 17 is a right-side view the support member of FIG. 16 with an embodiment of a back support member to be assembled therewith.
Figure 18:
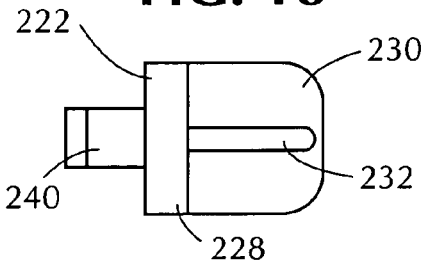
FIGS. 18-21 are respectively top, rear, cross-sectional side, and bottom views of a top housing member of a swivel assembly of the embodiment of FIG. 16, with FIG. 20 including a bottom housing member and front support member.
Figure 19:
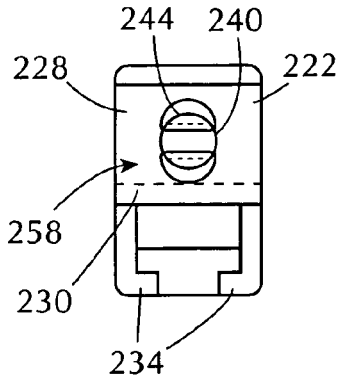

Referring to FIGS. 16 and 17, front support member 200 includes ribs 202 that preferably protrude laterally from the upper part of the lateral sides of the support member 200, and preferably extend horizontally to facilitate grasping by a user. A locking portion of the front support portion 200 includes a catch 204 extending upwardly and configured for entering and engaging downward-facing recess 206 of back support portion 208. Recess 210 of the front support member 200 is configured for receiving the enlarged ball-end of a hook portion, and is preferably molded into front wall 212 of the front support portion with an opening 214 in the rear, deepest part of the recess 210. Corresponding recesses 216 in gripping walls 218 are preferably concentric with the spherical recess 210 to retain the enlarged end of the hook portion in snap-fit association.

Figure 20:
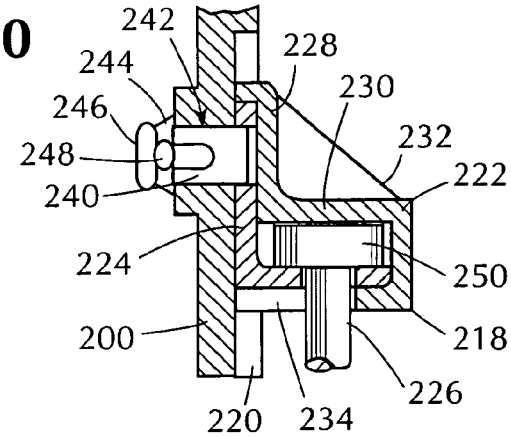
Figure 21:
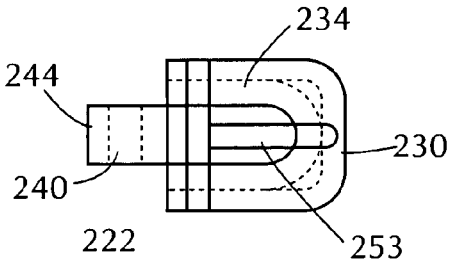
Figure 22:
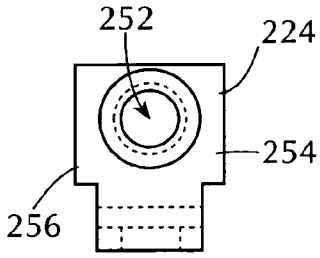
FIGS. 22-24 are respectively back, side, and bottom views of the bottom housing member of FIG. 20.
Figure 23:
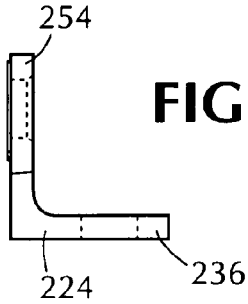
Figure 24:
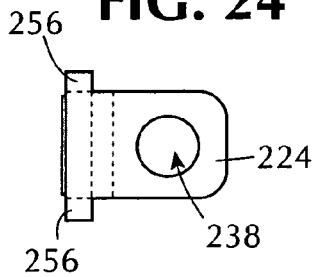

A swivel assembly 218, as shown in FIG. 20, is pivotally attached to the front support member 200, within recessed area 220, and is preferably a molded plastic. The swivel assembly has top and bottom housing members 222,224 that are connected to receive and retain hook member 226 rotatably therebetween. The top housing member 222 preferably has an L-shape, with upright and horizontal portions 228,230 and a diagonal gusset 232 extending between these portions 228,230. Gusset 232 is disposed adjacent the enlarged mounting portion 250 of hook 226 and is configured and dimensioned for stiffening and strengthening the swivel assembly 218, as well as for deflecting impact from a tool that is being inserted in the hook 226 to protect the swivel assembly 218 from damage. Thus, gusset 232 preferably extends from about the top end of the upright portion 228 to about the furthest portion therefrom of the horizontal portion 230.

An attachment protrusion, which is preferably a shaft 240, extends preferably rearwardly from the top upright portion 228 and is received in and engages swivel opening 242 of the front support member 200. The shaft includes a tapered and enlarged locking member 244 that is resiliently contractible for inserting in the swivel opening 242 and expandable so that the locking member 244 has a diameter larger than the swivel opening 242 to snap and lock the swivel assembly 218 to the front support member 200. A locking button 246 preferably has a ball portion 248 received and retained in a recess of the locking member 244 to maintain the locking member in the expanded and locked position shown in FIG. 20.

The top horizontal portion includes a track 234 configured for receiving and supporting horizontal portion 236 of the bottom housing member 224. Bottom horizontal portion 224 defines an opening 238 for receiving the hook member 226. To assemble the swivel assembly 218, the bottom housing member 224 with the hook 226 received in the opening 238 is slid onto the track 234 to retain an enlarged diameter end of mounting portion 250 of the hook 226 between the top and bottom housing members 222, 224. When assembled, the shaft 240 is received within shaft opening 252 of upright portion 254 of the bottom housing member 224 to provide support to the bottom housing member 224. Hook 226 is received within an elongated slot 253 within track 234. The hook 226 is thus trapped between the top and bottom housing portions 222,224. Additionally, the bottom upright portion 254 includes laterally extending wings 256 that are supportedly received in recess 258 of the top upright portion 228 above ledges 230.

The preferred tool holding members are large enough to receive the handle of a hand held tool, while being small enough to prevent passage of another part of the tool with greater dimensions. Preferably, the handle of this size tool is dimensioned to be operated with the fingers and the palm wrapped around the handle. Such preferred tools include wrenches, hammers, drills, hatchets, trowels, typing knives, and squeegees, and other T or L-shaped tools, including combination squares. Preferably, other tools of generally similar size can also be held in the tool holder, such as shears, snips, and spray bottles, which may be supported by hooking or inserting a part of the tool other than the handle to or into the tool holding member. To hold these tools, the tool holding member is preferably large enough to hold an elongated part of the tool that has a diameter of at least about a ½ inch, and more preferably of at least about ¾ inch. Thus, the tool holding member and the openings for holding the tool are preferably large enough to receive a cylindrical object of at least about ½ inch diameter, more preferably of at least about ¾ inch diameter, and most preferably of at least about 1 inch diameter, and preferably of at most about 3½ inches diameter, and more preferably of at most about 2½ inches diameter. Additionally, the lateral width and the vertical height of the support members are preferably at least about 2 inches and at most about 3½ inches.

While illustrative embodiments of the invention are disclosed herein, it will be appreciated that numerous modifications and other embodiments may be devised by those skilled in the art. For example, if the tool holder is made with separately manufactured front and back support members, these can be connected at locations other than at the top end of the top holder. In one embodiment, the back support member extends around the belt space and occupies a significant portion of the front side of the tool holder in front of the tool space, and in another embodiment, the front support member extends around the belt space and occupies a significant portion of the back side of the tool holder behind the belt space. Yet another embodiment has more than two support members that are attached together with the tool holding member to form the tool holder. Therefore, it will be understood that the appended claims are intended to cover all such modifications and embodiments that come within the spirit and scope of the present invention.

What is claimed is:

1. A tool holder for mounting to a user's clothing article, comprising:

a first support member of an injection-molded material;

a second support member connected to the first support member at a connection portion, wherein the first and second support members are configured and dimensioned for receiving and hooking around the article with the first and second support members disposed on opposite sides of the article, and at least one of the support members comprises a plurality of stiffening ribs extending therefrom and arranged substantially forming a truss that is configured for stiffening said at least one support member; and a tool holding member mounted to one of the support members and configured for receiving and holding a portion of a handheld tool.

2. The tool holder of claim 1, wherein the tool holding member defines an opening to receive and hold the portion of the tool, the opening being of sufficient size to receive a hand held tool having a diameter of at least about a ½ inch.

3. The tool holder of claim 2 further comprising a secondary tool holding member associated with at least one of the support members and tool holding member and configured for holding a second tool.

4. The tool holder of claim 3, wherein the secondary tool holding member defines at least one secondary tool recess configured and dimensioned for receiving and holding the secondary tool, and the tool holding portion is configured for holding a handle of the hand-held tool.

5. The tool holder of claim 4, wherein the recess has a ribbed, substantially cylindrical portion configured and dimensioned for holding a drill tip.

6. The tool holder of claim 5, wherein:

at least one of the support members defines a grasping recess that is sufficiently large to permit grasping by a user of a portion of a secondary tool disposed therein;

the secondary tool holding member is disposed for access thereto by the user in the grasping recess;

the grasping recess and secondary tool holding members being configured for holding the secondary tool in the secondary tool holding member with a graspable portion of the secondary tool protruding from the secondary tool holding member and disposed graspably within the grasping recess.

7. The tool holder of claim 3, wherein the secondary tool holding member comprises at least one resilient protrusion for engaging a recess of the secondary tool.

8. The tool holder of claim 7, wherein the secondary tool holding member comprises a plurality of resilient protrusions configured and dimensioned for engaging a socket for a socket wrench.

9. The tool holder of claim 8, wherein the resilient protrusions are movable with respect to each other to accommodate differently sized sockets.

10. The tool holder of claim 1, wherein the tool holding member defines a tool space configured for receiving and holding a hand-held tool and first and second openings on opposite sides of and communicated with the tool space, wherein the first opening is larger than the second opening for receiving a larger portion of the tool than the second opening.

11. The tool holder of claim 1, wherein the second support member comprises a receiving recess, the holding member mounting portion is received and supported in the recess, and the tool holder further comprises a closure attached adjacent the recess for closing the recess and retaining the holding member mounting portion pivotally therein.

12. The tool holder of claim 1, further comprising a mount pivotally attached to the second support member and pivotally supporting the holding member, wherein the mount has first and second portions disposed about the holding member to trap the holding member in the mount.

13. The tool holder of claim 1, further comprising a deflecting ramp disposed adjacent to the mount and configured and angled for deflecting impact from the tool as it is placed moved towards the tool holding member to be held thereby.

14. The tool holder of claim 1, wherein the retaining member is in a snap-fit association with the second support member.

15. The tool holder of claim 1, wherein the tool holding member comprises a generally U-shaped hook member configured for holding an elongated portion of a tool having a diameter of at least about ½ inch.

16. The tool holder of claim 1, wherein the support members are connected to each other and define an article space therebetween configured to receive the article, the first support member having substantially an S-curve shape to define a restricting space portion adjacent the article space, wherein the article space is wider than any restricting facing the restricting portion and the second support member to retain the article in the article space, the first support member curving away from the second support member toward the first end to facilitate insertion of the article from between the first ends.

17. The tool holder of claim 1, wherein the first and second ends are free ends having a configuration spaced from each other to receive the article therebetween by hooking the first and second support members around the article.

18. The tool holder of claim 1, further comprising a tool holding mount that is affixed to the a mounting portion of said one support member, the tool holding member being pivotally mounted to the mount.

19. The tool holder of claim 18, wherein the tool holding member is pivotable about two axis with respect to the mount.

20. The tool holder of claim 2, wherein the first and second support members are of separate construction.

21. The tool holder of claim 1, wherein the first and second support members are pieces of separate construction that are joined in to each other in a fixed position.

22. The tool holder of claim 1, wherein the first and second support members are of injection molded plastic.

23. A tool holder for mounting to a user's clothing article, comprising:

a first support member of an injection-molded material;

a second support member connected to the first support member at a connection portion, wherein the first and second support members are configured and dimensioned for receiving and hooking around the article with the first and second support members disposed on opposite sides of the article; and a tool holding member mounted to one of the support members and configured for receiving and holding a portion of a handheld tool;

wherein the first support member has a back surface facing away from the second support member and disposed for placement against a user's waist, the back surface having substantially flat portions surrounding a central area that forms a concave indentation that is curved to generally follow the curve of the user's waist.

24. The tool holder of claim 23, wherein:

the support members are connected to each other and define an article space therebetween configured to receive the article; and the first support member has a curved surface facing the article space and disposed to contact the article received therein.

25. The tool holder of claim 23, wherein said one support member comprises a recessed mounting portion for attaching with a correspondingly shaped mounting portion of the tool holding member.

26. The tool holder of claim 23, wherein the first and second support members are pieces of separate construction that are joined in to each other in a fixed position.

27. A tool holder for mounting to a user's clothing article, comprising:

a first support member;

a second support member connected to the first support member at a connection portion, wherein the first and second support members have first ends opposite from the connection portion and have a configuration and are dimensioned for receiving the article through between the first ends and hooking the first and second support members around the article with the first and second support members disposed on opposite sides of the article; and a tool holding member mounted to the second support member and having an operative position extending from the second support member for receiving and holding a portion of a hand-held tool and being retractable to a retracted position for decreasing the bulk of the tool holder, wherein the tool holding member is disposed substantially flush against the second support member in the retracted position such that in the retracted position the holding member is substantially prevented from holding the portion of the tool.

28. The tool holder of claim 27, wherein the tool holding member is pivotally connected to the second support member for pivoting between the operative and retracted positions.

29. The tool holder of claim 28, wherein:

the second support member comprises a front face facing away from the second support member; and the tool holding member is pivotable towards and away from the front face.

30. The tool holder of claim 27, wherein the first and second support members are associated with first and second connection portions, respectively, and are pieces of separate construction that are joined to each other in a fixed position.

31. The tool holder of claim 30, wherein the connection portions are configured for engagement with each other.

32. The tool holder of claim 31, further comprising a locking portion associated with the support members for locking the support members together in secured association.

33. The tool holder of claim 30, wherein:

at least one of the connecting portions comprises a connecting extension; and at least the other of the connecting portions comprises a connecting recess configured to engage the connecting extension for securing the first and second connecting portions to each other.

34. The tool holder of claim 30, wherein the first and second support members are substantially coupled to each other with the connecting portions in attached association.

35. The tool holder of claim 27, wherein the second support member has a front face that comprises a recess facing the tool holding member and is configured and dimensioned for receiving another portion of the tool held in the tool holding member.

36. The tool holder of claim 35, wherein the tool holding member has a generally rounded portion defining a rounded shape for holding a round portion of the tool, and the recess comprises an indentation in the second support member disposed substantially concentrically with the rounded shape of the tool holding member.

37. The tool holder of claim 27, wherein the tool holding member includes a notch configured for receiving and positioning a portion of the tool in a predetermined orientation.

38. The tool holder of claim 30, wherein at least one of the first and second support members comprises a projection facing the other of the support members for resisting removal of the tool holder from the article.

* * * * *